US009540899B1

(12) United States Patent
Doane et al.

(10) Patent No.: US 9,540,899 B1
(45) Date of Patent: Jan. 10, 2017

(54) DOWNHOLE SEAL APPARATUS AND METHOD THEREOF

(71) Applicants: James C. Doane, Friendswood, TX (US); Gary L. Anderson, Humble, TX (US)

(72) Inventors: James C. Doane, Friendswood, TX (US); Gary L. Anderson, Humble, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 833 days.

(21) Appl. No.: 13/897,614

(22) Filed: May 20, 2013

(51) Int. Cl.
*E21B 33/12* (2006.01)
*E21B 33/1295* (2006.01)

(52) U.S. Cl.
CPC ..... *E21B 33/12* (2013.01); *E21B 33/1295* (2013.01)

(58) Field of Classification Search
CPC ... E21B 33/12; E21B 33/1295; E21B 33/1208
See application file for complete search history.

(56) References Cited

U.S. PATENT DOCUMENTS 4,573,537 A * 3/1986 Hirasuna ..... E21B 33/1292 166/134
5,333,692 A 8/1994 Baugh et al.
7,448,445 B2 11/2008 Doane et al.
7,748,467 B2 7/2010 Doane
8,109,340 B2 2/2012 Doane et al.
2008/0251250 A1* 10/2008 Brezinski ..... E21B 33/12 166/179
2010/0025049 A1* 2/2010 Korte ..... E21B 23/06 166/387

OTHER PUBLICATIONS

James Walker, "Downhole Sealing Guide" Issue 2, www.jameswalker.biz, BP4337 0810/1m, James Walker 2010, pp. 1-6.
Gunnar Debruijn, et al. "High-Pressure, High-Temperature Technologies" Oilfield Review, Schlumberger, Autumn 2008, pp. 46-60.

* cited by examiner

*Primary Examiner* — Robert E Fuller
*Assistant Examiner* — David Carroll
(74) *Attorney, Agent, or Firm* — Cantor Colburn LLP

(57) ABSTRACT

A method of forming a downhole seal between inner and outer tubulars. The method including bonding a sealing element to an insert with a bond that bonds at temperatures less than a first temperature and increasingly breaks down at temperatures higher than the first temperature. Defeating the bond between the sealing element and the insert at a second temperature higher than the first temperature; and, subsequently forming a seal between the inner and outer tubulars with the sealing element. Also included is a downhole sealing apparatus.

20 Claims, 3 Drawing Sheets

DOWNHOLE SEAL APPARATUS AND METHOD THEREOF

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Resilient sealing rings are widely used on the outer surfaces of downhole tools such as packers, space-out assemblies, and anchors. The sealing ring typically engages an outer tubular member, such as a casing, in a borehole. A tubular seal apparatus includes an inner tubular member positioned coaxially within the outer tubular member having an annular space there between, and the sealing ring is used to provide a seal between the inner and outer tubular members. The sealing material of the ring may also be used to provide a more flexible or expandable connection between two components of a downhole tool.

The sealing material of the sealing ring is conventionally secured to the downhole tool such that the sealing ring stays secured to the downhole tool. In some downhole tools, the sealing ring is secured to an outer diameter surface of a metal reinforcing ring of the downhole tool. Ramp set packers move the sealing ring, including the metal reinforcing ring, radially outwardly with a ramp, such as a swaging cone. When set, the reinforcing ring is expanded plastically beyond the yield strength of the metal of the reinforcing ring. Chemical bonding and mechanical configurations are used to secure and retain the sealing material relative to the reinforcing ring to increase the life of the downhole tool by increasing the length of time the sealing ring remains bonded to the reinforcing ring.

The art would be receptive to improved apparatus and methods for a downhole tubular to tubular seal.

BRIEF DESCRIPTION

A method of forming a downhole seal between inner and outer tubulars, the method includes bonding a sealing element to an insert with a bond that bonds at temperatures less than a first temperature and increasingly breaks down at temperatures higher than the first temperature; defeating the bond between the sealing element and the insert at a second temperature higher than the first temperature; and, subsequently forming a seal between the inner and outer tubulars with the sealing element.

A downhole sealing apparatus includes a sealing element; a metal insert; and, a bond formed of a bonding agent configured to bond the sealing element to the metal insert at temperatures less than a first temperature and to eliminate bonding between the sealing element and the metal insert at temperatures greater than a second temperature, at least 50 degrees larger than the first temperature, wherein the bond is configured to be broken prior to actuating the downhole sealing apparatus.

BRIEF DESCRIPTION OF THE DRAWINGS

The following descriptions should not be considered limiting in any way. With reference to the accompanying drawing, like elements are numbered alike.

DETAILED DESCRIPTION

A detailed description of one or more embodiments of the disclosed apparatus and method are presented herein by way of exemplification and not limitation with reference to the Figures. A method shall be described that employs a disappearing bond in a downhole seal apparatus to employ the bond between a sealing material and a metal insert to initially prevent swabbing off, and then to intentionally negate the effects of the bond at certain conditions to allow the sealing material to advantageously operate in a non-bonded condition from the metal insert. Having the bond intentionally break down at certain conditions is contrary to ordinary engineering thinking, as the connection between the sealing material and metal insert is conventionally designed to be maintained. To gain a better understanding of this method, an exemplary embodiment of a downhole seal apparatus will first be described.

Figure 1:
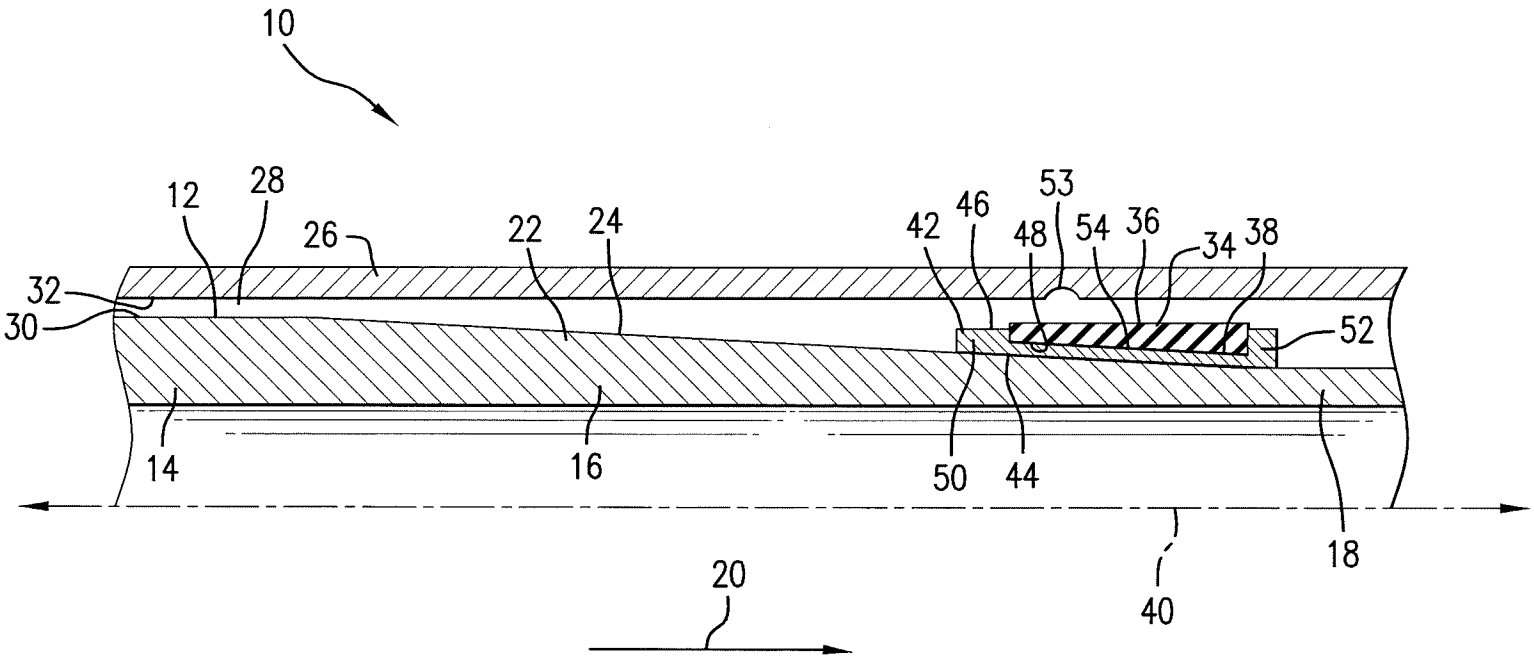
FIG. 1 shows a partial cross-sectional view of an exemplary embodiment of a downhole seal apparatus.

An exemplary embodiment of a high temperature/high pressure downhole seal apparatus 10, such as, but not limited to a packer, is shown in FIG. 1. The downhole seal apparatus is positionable within a borehole. A first tubular 12 is an inner tubular and depicted as a tubing in the downhole seal apparatus 10. The first tubular 12 includes a first portion 14 that is substantially cylindrically shaped, with a substantially constant outer diameter, a second portion 16 that is substantially frusto-conically shaped and tapered radially inwardly from an outer diameter of the first portion 14, and a third portion 18 that is substantially cylindrically shaped, with a substantially constant outer diameter less than the outer diameter of the first portion 14. The second portion 16 has an outer diameter that decreases from a first end connected to the first portion 14 to a second end connected to the third portion 18, in the direction 20. The direction 20 may be a downhole direction, although the direction could alternatively be an uphole direction. The second portion 16 thus forms a swaging cone 22 with a cam surface 24. A second tubular 26 is an outer tubular. When the second tubular 26 is a casing, it is positionable within a borehole to line the borehole. The second tubular 26 could alternatively be another outer tubular of a downhole tool. In an alternative embodiment, the seal apparatus 10 is used within an open borehole and the second tubular 26 is the borehole wall itself. An annulus 28 is provided between an outer wall surface 30 of the first tubular 12 and an inner wall surface 32 of the second tubular 26.

The seal apparatus 10 further includes a sealing element 34, such as a sealing ring, made of a seal material, such as, but not limited to, rubber. An outer wall surface 36 of the sealing element 34 is substantially cylindrically shaped, with a substantially constant outer diameter, for sealing against the inner wall surface 32 of the second tubular 26. An inner wall surface 38 of the sealing element may be frusto-conically shaped, with a decreasing inner diameter in the direction 20 as illustrated, however the inner wall surface 38 may alternatively have a profile that forms any other angle with the longitudinal axis 40 of the downhole seal apparatus 10. For example, the inner wall surface 38 may be substantially cylindrically shaped.

The sealing element 34 is bonded to a metal insert 42, which may also be ring shaped as shown, to prevent the sealing element 34 from swabbing off the metal insert 42 when the metal insert 42 and sealing element 34 are exposed to wellbore heat or to annular fluid flow past the outer wall surface 36. The metal insert 42 includes an inner wall surface 44 that may form an angle with the longitudinal axis 40 of the downhole seal apparatus 10 that is substantially the same angle as the cam surface 24 of the swaging cone 22 to the longitudinal axis 40. That is, a cross-section of the inner wall surface 44 is substantially parallel to a cross-section of the cam surface 24 as shown in FIG. 1. The metal insert 42 further includes an outer wall surface 46 that includes an indented receiving portion 48 that is recessed radially inward to receive the sealing element 34 therein. The indented receiving portion 48 may also be frusto-conically shaped as illustrated, however may alternatively form different angles with respect to the longitudinal axis 40. The profile of the indented receiving portion 48 substantially conforms to the profile of the inner wall surface 38 of the sealing element 34. First end portion 50 and second end portion 52 each form a shoulder that respectively abuts with opposing axial ends of the sealing element 34. An outer diameter of the first and second end portions 50, 52 of the metal insert 42 may be substantially the same as each other to form a substantially cylindrical portion of the metal insert 42. The outer diameter of the first and second end portions 50, 52 of the metal insert 42 may be less than the outer diameter of the sealing element 34, such that the sealing element 34 makes first contact with the inner wall surface 32 of the second tubular 26 during operation, as shown in FIG. 3, however alternative embodiments may allow the metal insert 42 to contact first.

Figure 3:
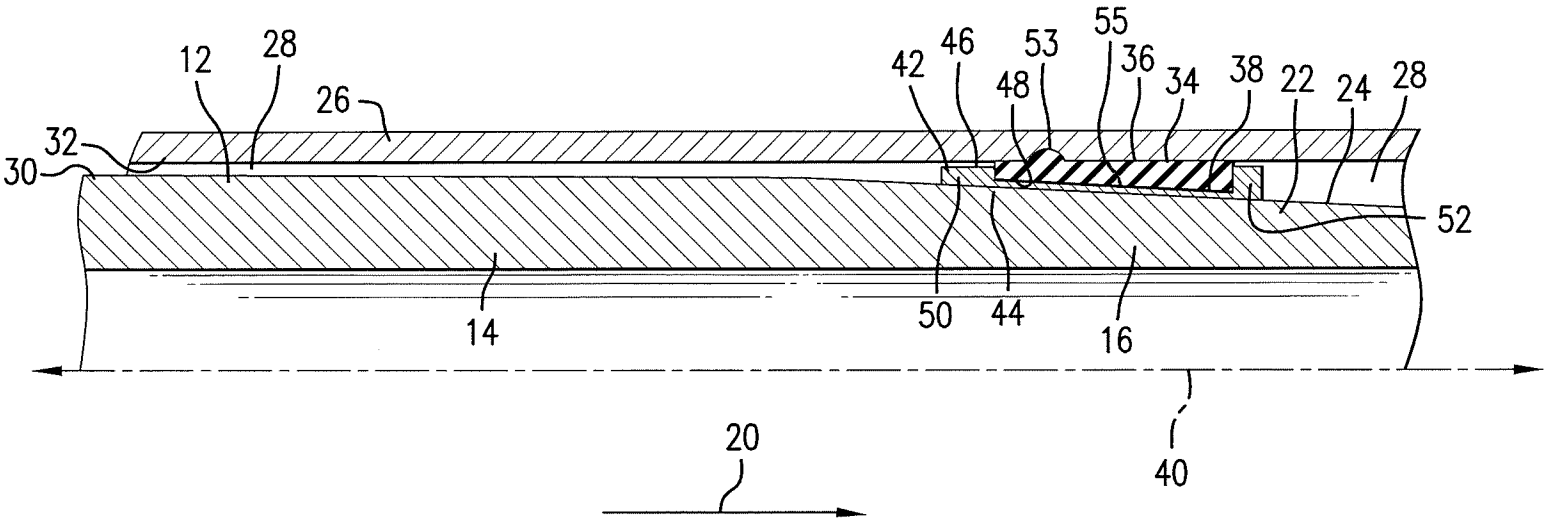

In operation, as shown in FIG. 3, axial actuation of the first tubular 12 in the direction 20 forces diametrical deformation of the metal insert 42 and the sealing element 34 towards the inner wall surface 32 of the second tubular 26. The sealing element 34 sealingly engages with the inner wall surface 32 of the second tubular 26 to seal the first tubular 12 to the second tubular 26 in a manner which segregates an uphole portion of the annulus 28 from a downhole portion of the annulus 28.

Figure 2:
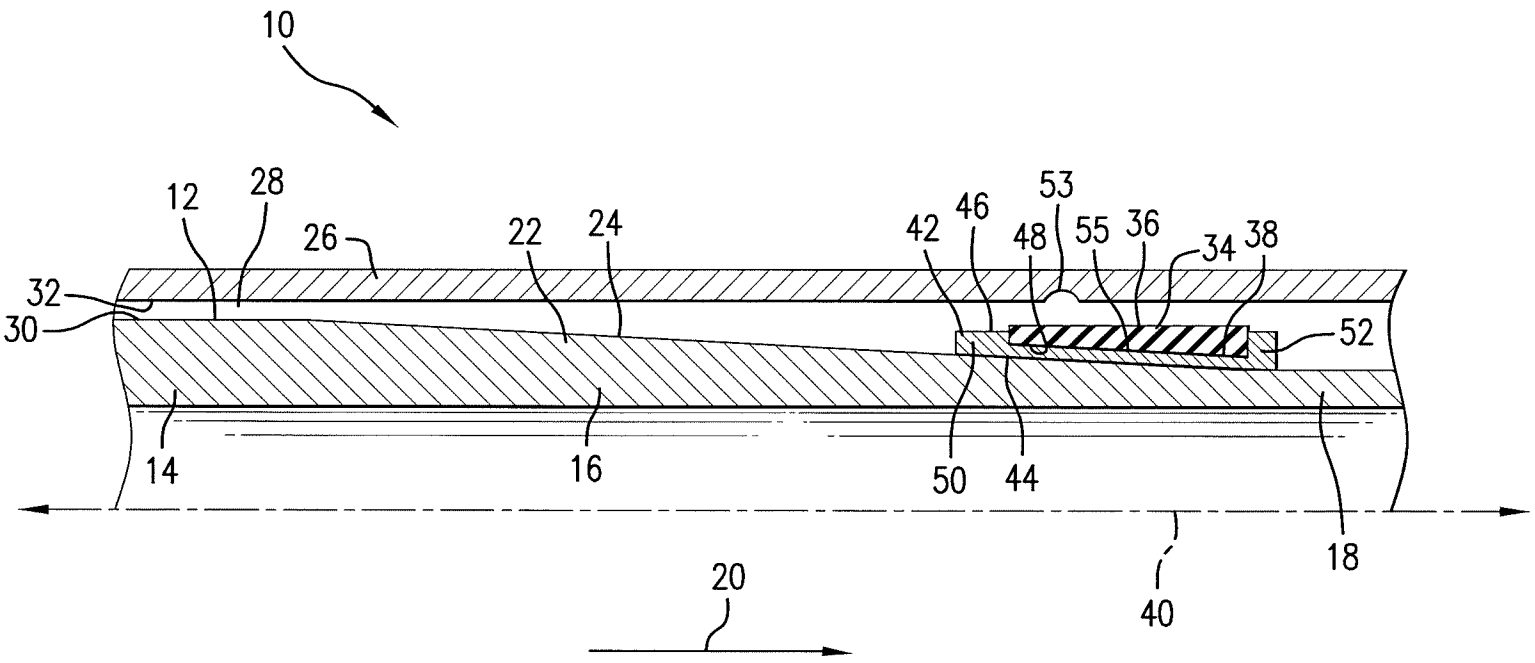
FIG. 2 shows a partial cross-sectional view of the downhole seal apparatus of FIG. 1 in a defeated condition of a bond within the seal apparatus; and, FIG. 3 shows a partial cross-sectional view of the downhole seal apparatus of FIG. 2 in sealing engagement with an outer tubular.

As noted above, the sealing element 34 is bonded to the metal insert 42 by a disappearing bond 54. The bond 54 will initially prevent fluid pressure from the annulus 28 from entering and equalizing with the area between the inner wall surface 38 of the sealing element 34 and the outer wall surface 46 including the indented receiving portion 48 of the metal insert 42 at lower hydrostatic pressures, such as during initial run-in of the metal insert 42 and sealing element 34 into a borehole, as shown in FIG. 1. As demonstrated by FIG. 2, at higher hydrostatic pressures, such as further down the borehole, the sealing element 34 will be held down by the higher hydrostatic pressures without the bond 54. At that point, even prior to when the sealing element 34 is to be set between the first and second tubulars 12, 26, the bond between the sealing element 34 and insert 42 is not needed because the sealing element is held to the insert 42 by the higher hydrostatic pressure. In fact, it has been determined that once the downhole seal apparatus 10 is actuated, the sealing performance of the downhole seal apparatus 10 will be improved if the sealing element 34 is not bonded to the metal insert 42 at this stage. Since the hydrostatic pressure increases as the temperature increases, the bond 54 is selected to hold up to a certain temperature and then breakdown at higher temperatures. More particularly, a bonding agent is selected for the disappearing bond 54 which holds the sealing element 34 to the metal insert 42 at lower temperatures, such as at temperatures less than a first temperature of about 200 degrees F., and then disappears at higher temperatures, such as temperatures greater than 50 degrees or more higher than the first temperature, such as temperatures greater than a second temperature of about 400 degrees F. or higher. The bond 54 will increasingly break down at temperatures greater than the first temperature, and will be incapable of bonding at the second temperature. The state of the bond 54 in a broken down or defeated condition is demonstrated by area 55 in FIG. 2, between the sealing element 34 and metal insert 42. An exemplary bonding agent for the disappearing bond may be, but is not limited to, a resin, polyurethane, or epoxy having the above described characteristics and is selected based on the materials of the sealing element 34 and metal insert 42. The bond desirably breaks down at temperatures greater than the first temperature until the sealing element 34 is in a non-bonded condition with respect to the metal insert 42, as demonstrated by area 55, prior to setting to allow the sealing element 34 to move into irregularities 53 in the second tubular 26 and thus form an improved seal between the first and second tubulars 12, 26 in contrast to a sealing element that is restricted from movement by its adhesion to a metal insert. That is, if the sealing element 34 is locked down within the metal insert 42 by a bond and/or other mechanical constraints, it cannot conform as well to an irregular open borehole or irregular tubular shapes. Thus, in an exemplary embodiment, the inner wall surface 38 of the sealing element 34 and outer wall surface 46 within the indented receiving portion 48 of the metal insert 42 have common profiles with substantially smooth uninterrupted common profiles, such as those that have constant outer diameters or substantially constant angles with respect to the longitudinal axis 40, and are engaged together (and subsequently disengaged) by the bond only, rather than by additional inter-engaging mechanical protrusions, gripping configurations, and indentations there between.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of forming a downhole seal between inner and outer tubulars, the method comprising:

bonding a sealing element to an insert with a bond that bonds at temperatures less than a first temperature and increasingly breaks down at temperatures higher than the first temperature;

defeating the bond between the sealing element and the insert at a second temperature higher than the first temperature; and, subsequently forming a seal between the inner and outer tubulars with the sealing element including axially actuating a swaging cone of the first tubular relative to the insert, and axially actuating the swaging cone includes deforming the insert and sealing element radially outwardly.

2. The method of claim 1 further comprising allowing the sealing element to move into irregularities in an inner wall surface of the outer tubular, wherein movement of the sealing element into irregularities is facilitated through defeat of the bond.

3. The method of claim 1 further comprising, prior to defeating the bond, retaining the sealing element on the insert at a first pressure by maintaining the bond between the sealing element and the insert at the first pressure; and, subsequent defeating the bond, retaining the sealing element on the insert by a second pressure higher than the first pressure.

4. The method of claim 1 wherein the sealing element includes an outer wall surface, a cross-section of which is substantially parallel to a cross-section of the inner wall surface of the outer tubular.

5. The method of claim 4 wherein the insert includes an inner wall surface, a cross-section of which is substantially parallel to the cross-section of the outer wall surface of the swaging cone.

6. The method of claim 1 wherein forming a seal between inner and outer tubulars includes forming a seal between the inner tubular and a borehole wall of the outer tubular and the sealing element moves into irregularities in the borehole wall.

7. A method of forming a downhole seal between inner and outer tubulars, the method comprising:

bonding a sealing element to an insert with a bond that bonds at temperatures less than a first temperature and increasingly breaks down at temperatures higher than the first temperature;

defeating the bond between the sealing element and the insert at a second temperature higher than the first temperature; and, subsequently forming a seal between the inner and outer tubulars with the sealing element;

wherein bonding the sealing element to the insert includes arranging the sealing element within an indented receiving portion in the insert.

8. The method of claim 1 wherein bonding a sealing element to an insert includes providing an inner wall surface of the sealing element and an outer wall surface of a seal receiving portion of the insert with substantially smooth uninterrupted common profiles and retaining the sealing element to the insert via the bond at the first temperature.

9. The method of claim 1 wherein bonding a sealing element to an insert includes selecting a bond that holds at temperatures less than 200 degrees Fahrenheit and breaks down at temperatures greater than 200 degrees Fahrenheit.

10. A method of forming a downhole seal between inner and outer tubulars, the method comprising:

bonding a sealing element to a receiving portion of an insert with a bond that bonds at temperatures less than a first temperature and increasingly breaks down at temperatures higher than the first temperature, the receiving portion of the insert disposed radially between the inner tubular and a full length of the sealing element, and the bond disposed radially between the sealing element and the receiving portion of the insert;

defeating the bond between the sealing element and the insert at a second temperature higher than the first temperature; and, subsequently forming a seal between the inner and outer tubulars with the sealing element, the sealing element disposed radially between the insert and the outer tubular;

wherein defeating the bond includes destroying adhesive characteristics of the bond at the second temperature to provide the sealing element in a non-bonded condition relative to the insert prior to forming the seal.

11. A downhole sealing apparatus comprising:

a sealing element;

a metal insert;

a bond disposed between the sealing element and the metal insert and formed of a bonding agent configured to bond the sealing element to the metal insert at temperatures less than a first temperature and to eliminate bonding between the sealing element and the metal insert at temperatures greater than a second temperature, at least 50 degrees larger than the first temperature, wherein the bond is configured to be broken prior to actuating the downhole sealing apparatus; and, an inner tubular including a swaging cone, configured to actuate the downhole sealing apparatus, wherein the sealing element is not deformed diametrically until actuation of the swaging cone.

12. The downhole sealing apparatus of claim 11, wherein the first temperature is about 200 degrees Fahrenheit.

13. The downhole sealing apparatus of claim 11 further comprising an outer tubular.

14. The downhole sealing apparatus of claim 13 wherein the outer tubular is an open borehole.

15. The downhole sealing apparatus of claim 13 wherein the metal insert has an inner wall surface, a cross-section of which is substantially parallel to a cross-section of an outer wall surface of the swaging cone.

16. The downhole sealing apparatus of claim 15 wherein the sealing element has an inner wall surface, a cross-section of which is substantially parallel to the cross-section of the outer wall surface of the metal insert, and an outer wall surface of the sealing element has a cross-section substantially parallel to a cross-section of an inner wall surface of the outer tubular.

17. The downhole sealing apparatus of claim 13 wherein the bond is configured to exhibit no bonding characteristics during sealing of the inner tubular to the outer tubular to allow the sealing element to conform to irregularities in the outer tubular.

18. The downhole sealing apparatus of claim 13 wherein the sealing element and metal insert are positioned within an annulus between the inner and outer tubulars.

19. A downhole sealing apparatus comprising:

a sealing element;

a metal insert; and, a bond formed of a bonding agent configured to bond the sealing element to the metal insert at temperatures less than a first temperature and to eliminate bonding between the sealing element and the metal insert at temperatures greater than a second temperature, at least 50 degrees larger than the first temperature, wherein the bond is configured to be broken prior to actuating the downhole sealing apparatus;

wherein the metal insert includes an outer wall surface having a seal receiving indent receiving the sealing element therein.

20. The downhole sealing apparatus of claim 19 wherein the seal receiving indent of the metal insert and an inner wall surface of the sealing element both have a substantially smooth common profile.

* * * * *